US005364304A

United States Patent [19]

Hampton

[11] Patent Number: 5,364,304

[45] Date of Patent: Nov. 15, 1994

[54] REMOTELY CONTROLLED ELECTRICALLY ACTUATED AIR FLOW CONTROL REGISTER

[75] Inventor: Brian Hampton, Rockford, Ill.

[73] Assignee: Hampton Electronics, Inc., Rockford, Ill.

[21] Appl. No.: 170,090

[22] Filed: Dec. 17, 1993

Related U.S. Application Data

[63] Continuation-in-part of Ser. No. 6,459, Jan. 21, 1993, Pat. No. 5,271,558.

[51] Int. Cl.[5] ..... F24F 7/00

[52] U.S. Cl. ..... 454/258; 236/49.3; 236/51

[58] Field of Search ..... 236/49.3, 51; 454/258

[56] References Cited

U.S. PATENT DOCUMENTS

| | | | |
|---|---|---|---|
| 2,540,958 | 2/1951 | Newton | 236/49.3 |
| 4,824,012 | 4/1989 | Tate | 236/51 X |
| 5,251,815 | 10/1993 | Foye | 236/51 X |

*Primary Examiner*—William E. Wayner
*Attorney, Agent, or Firm*—Harold A. Williamson

[57] ABSTRACT

The invention relates to an air flow controllable register unit for controlling flow of air through the register from an air circulating system having a register air flow supply duct. The air flow is controlled in response to an externally provided control signal that commands the register flow control unit to provide differing air flow rates through the register. The register unit includes a register flow control apparatus which has a power generating device that includes a rotary mounted air turbine positioned within the register air flow supply duct. The air turbine is coupled to a generator to drive the same upon air flow against blades of the turbine. The air driven turbine initially restricts air flow of the register at system start-up.

A blade pitch control device is coupled to the blades and is responsive to the air turbine rotary speed to cause the blades to rotate into an air flow restricting position when the air circulating system is at start-up with system air flow rates at a minimum and into a reduced air flow restriction position allowing higher air flow rates when the rotary turbine speed has increased.

The register flow control apparatus is responsive to the externally provided control signal to provide a loading of the generator so that the air turbine is braked to thereby reduce the rotary turbine speed and cause the blade pitch control device to rotate the blades into an air flow restricting position which produces a lower air flow rate from the register.

12 Claims, 9 Drawing Sheets

FIG. 1
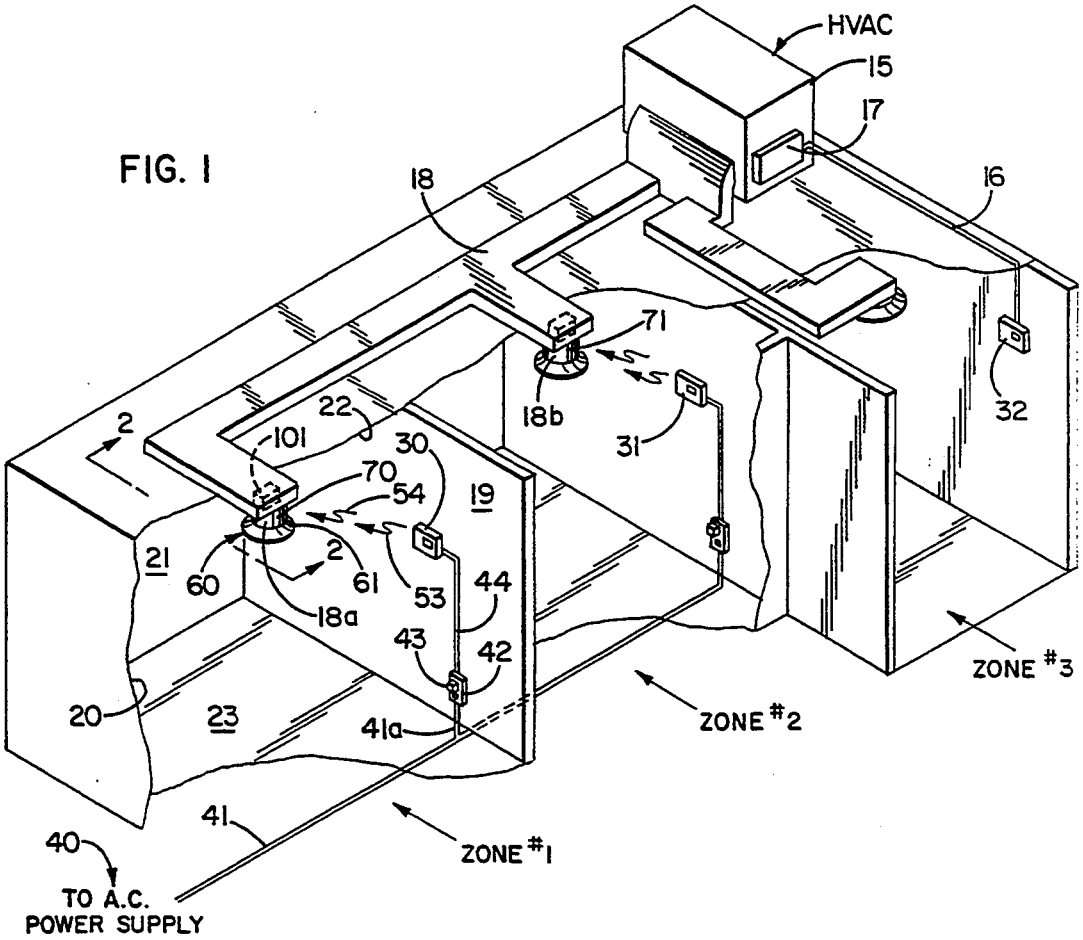
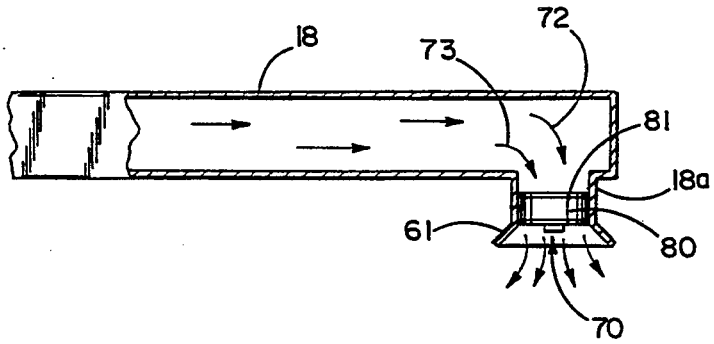
FIG. 2

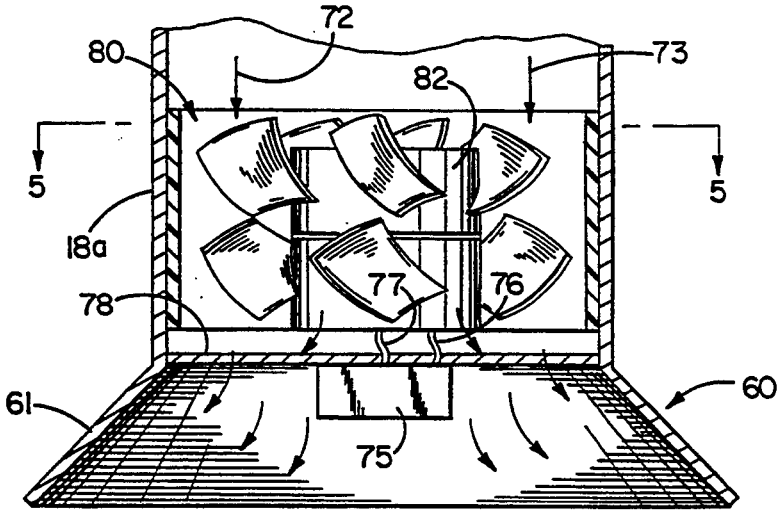
FIG. 3
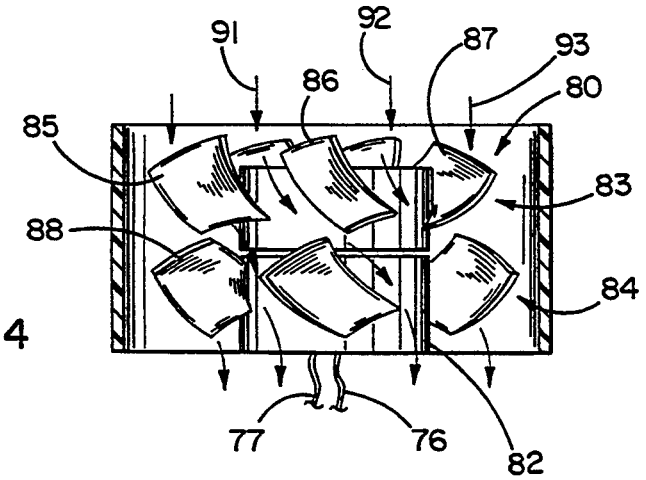
FIG. 4
FIG. 5
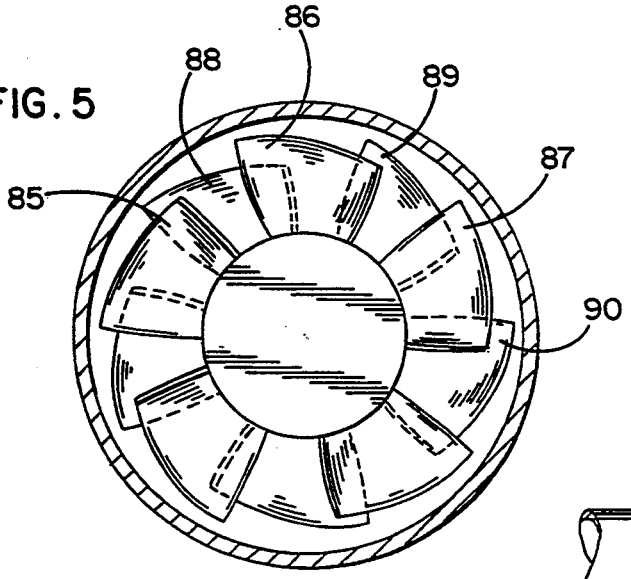
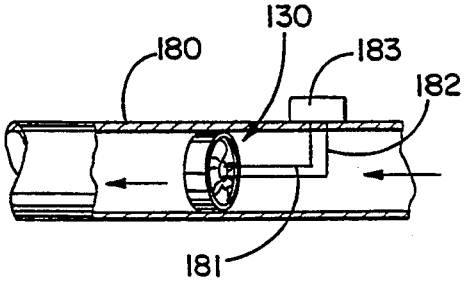
FIG. 10

| | | LOGIC UNIT | | | |
|---|---|---|---|---|---|
| INPUT "A" | | HEATING MODE INPUT HI | | COOLING MODE INPUT LO | |
| INPUT "B" | | $T_Z > T_{ZSP}$ (LO) | $T_Z \leq T_{ZSP}$ (HI) | $T_Z > T_{ZSP}$ (LO) | $T_Z \leq T_{ZSP}$ (HI) |
| INPUT "C" | RECHARGE NOT REQUIRED (HI) | SHORT | OPEN | OPEN | SHORT |
| | FULL CHARGE REQUIRED (LO) | OPEN | OPEN | OPEN | OPEN |

OPEN = GENERATOR FREEWHEELING

SHORT = GENERATOR OUTPUT SHORTED
GENERATOR ROTOR ROTATION IMPEDED

REMOTELY CONTROLLED ELECTRICALLY ACTUATED AIR FLOW CONTROL REGISTER

This application is a continuation-in-part of U.S. patent application No. 08/006,459, filed Jan. 21, 1993 now U.S. Pat. No. 5,271,558 issued Dec. 21, 1993.

FIELD OF THE INVENTION

A control system and air flow control register for use in a single or multi zone HVAC unit where air is delivered into one or more zones through an air delivery register(s).

BACKGROUND OF THE INVENTION

It has been long recognized in large building structures that the cost of heating or cooling the structure significantly impacts the bottom line of the large business enterprise that occupy these structures. It is also known that for a small business entities such as a clinic, office or retail structure total energy costs related to lighting, heating or cooling breaks down this way: 40% is for heating and cooling, 40% for lighting and the balance for business related equipment. The U.S. Department of Energy estimates that a substantial portion of the heating, cooling and lighting cost is wasted as a result of the lack of an economical, effective system to control it.

In the design stage of large business structures elaborate lighting, heating and cooling control systems are built into the structures at the outset with an expectation that significant energy savings translated into dollars will be realized for the businesses occupying these structures. In the smaller business building market almost all heating and ventilation systems employ a single zone HVAC unit to supply conditioned, heated or cool air to more than one distinct zone or room. Each room or zone may have different comfort requirements due to occupancy differences, individual preferences, exterior load differences or the different zones may be on different levels, thereby creating different heating or cooling requirements. This type of system is referred to a single zone HVAC unit because it is normally controlled from one centrally located ON/OFF thermostat controller. In a building which may have more that one zone and whose zones have different heating, cooling requirements, it becomes difficult to choose a good representative location for the thermostat controller.

In the technical literature which embrace patented technologies there have been a number of note worthy attempts to provide systems that address the problems of controlling the different needs of more than one zone which is provided heating and cooling from a single zone HVAC.

One such U.S. patent is that of Tate et al U.S. Pat. No. 4,969,508 (508) in which the temperatures in the room(s) are controlled by means of a wireless portable remote control unit which may be hand held by the room occupant. The wireless remote control unit transmits information to a remote receiver in the ceiling of the room, which in turn provides signals to a main control unit physically coupled to external environmental control units such as the air conditioning system, heater, damper motors and the like.

The wireless remote control unit of the '508 patent in addition to being able to select heating and cooling modes may also operate in an energy saving mode. To this end a light sensing circuit is provided for overriding preselected conditions when the lights in the room are off. An infra red transmitter is employed for transmitting data to an infra red receiving unit on the ceiling when the lights are on.

The subject invention distinguishes over the '508 patent in that there is no requirement for individually motor powered dampers in the air supply ducts adjacent each zone to be controlled. Use of the subject invention allows for a simple installation of a self contained automatically controlled register. The '508 patent further requires wiring of the entire duct work system to provide power of the many power driven dampers employed. The subject invention avoids this by not requiring such wiring and therefore making it easier and less expensive to install.

Another approach to providing multiple heating-/cooling zones which employ a single zone HVAC unit is shown and described in the Parker et al U.S. Pat. No. 4,530,395 ('395). The Parker et al arrangement provides zone control in plural zones in which each zone includes a control thermostat that is interfaced with a monitoring system so that each zone thermostat controls the HVAC unit as well as a damper unit for that particular zone. More specifically the system is comprised of two or more computerized thermostats which control both the HVAC unit through the monitoring control and the air distribution system of each zone through the damper for each zone. The thermostats also operate under control of signals received from the monitor.

The '395 is classic in its complex solution to the very simple concern of independently and automatically controlling the temperature in one of many zones simultaneously. The '395 patent like the '508 just reviewed requires electrically powered motors for each air flow control damper provided for each zone. The subject invention requires no such complex wiring and may be readily installed in air and existing HVAC system by simply removing a selected air distribution register and placing within an exposed air supply duct the apparatus of the instant invention. A wireless thermostat control device hung on a wall of a zone wall completes the installation of the subject invention in almost no time at all with little labor cost.

In yet another multiple zone system having a single central HVAC unit Robert S. Didier in his U.S. Pat. No. 4,479,604 ('604) shows and describes a controller for a central plant feeding a plurality of adjustable zone regulators which bring their respective zones to corresponding target temperatures. The controller has a plurality of temperature sensors and a plurality of zone actuators. The temperature sensors distributed one to a zone, each produce a zone signal signifying zone temperature. The zone actuators each have a zone control terminal. Each actuator can, in response to a signal at its zone control terminal, operate to adjust a corresponding one of the zone regulators. The controller also has a control means coupled to each of the temperature sensors and to the zone control terminal of each zone actuator for starting the central plant. The central plant is started in response to a predetermined function of zone temperature errors (with respect to their respective target temperatures) exceeding a given limit. The systems considers the temperature error in each of the zones. When the sum of the errors exceeds a given number, the furnace or air conditioner can be started.

In addition to the distinctions offered in respect of the '508 and '395 patents the subject invention is amazingly simple in design and generates its own power to thereby obviate the need of complex wiring system inherent in the '604 patent.

SUMMARY OF THE INVENTION

Simply stated the invention provides an electrically actuated automatically adjustable air register that is responsive to an externally delivered air flow control signal delivered to the automatically adjustable air register.

More specifically the invention is directed to a control system for an air delivery system having a supply duct through which air is delivered into at least one independently controlled zone or room through an air delivery register. The control system for one zone or room includes a wireless air flow control thermostat to transmit a wireless air flow control signal output to an electrically powered and electrically self sufficient register air flow control unit that controls the flow of the air through the register in response to receiving the wireless airflow control signal output. The electrically powered and electrically self sufficient register air flow control unit includes an electrical generator to provide power in response to flow of air through the register from the supply duct. The generated electric power is delivered to the register air flow control unit to thereby maintain the register flow control unit electrically self sufficient and free from the need of any outside electrical power source.

It is therefore a primary object of the invention to provide an electrically controlled automatically adjustable air register.

Another object of the invention is to provide the automatically adjustable register with a wireless remote control unit that is automatically responsive to desired air temperatures in a zone or room in which one or more automatically controlled register(s) provide conditioned air.

Yet another object of the invention is to provide as an addition to an existing forced air heating and cooling equipment with ON/OFF control a control system embodying the invention. The inventive control system is an inherently economical low cost device that can be installed quickly and easily without cutting into existing duct work or adding and pulling wires through ceiling or walls. The absence of wires reduces possible shock hazard. In addition, the absence of wires to be employed to activate, control or communicate with the automatically adjustable air register results in no disruption of a business's services during the installation of the control system.

Still yet another object of the invention is to provide an automatic electronically controlled, adjustable air register which includes a simple, reliable air flow driven electrical generator that is quiet in operation and provides electrical power to maintain electrical power to electronic circuits involved in the automatic electronic control of the adjustable air register.

A further object of the invention is to provide an automatically adjustable air flow register that does not cause static air pressure problems for the air conditioning portion of the system.

It is still yet another object of the invention to provide an automatically adjustable air register that can provide an infinite control of air flow from the register in a relatively wide range e.g. 95% to 65%.

A further object of the invention is to provide an automatically adjustable air flow register that when added to an existing system has minimal affect on air flow when a free flow of air through the register is desired.

And yet another object of the invention is to provide a method of controlling air flow in a system by employing a controllable air turbine/generator in the system.

A further enhancement to the invention is the provision of a novel method of controlling air flow in an air circulating system by the step of initially restricting air flow is a portion of the system at system staff-up by means of an air driven blade pitch controlled turbine positioned in the air flow. The step of initially restricting air flow is followed by a step of reducing air flow restriction caused by the air driven blade pitch controlled turbine in the air flow, changing blade pitch in response to an increase in rotary speed of the air turbine induced by passage of air flow through the air flow turbine after initial start-up. A final step involves braking the air driven turbine to reduce rotary speed causing a blade pitch change and return to a condition of initial air flow restriction in that portion of the system. The braking of the air driven turbine may be accomplished by coupling a generator to a turbine blade hub of the air turbine to be driven thereby. Loading the generator results in a braking of the air turbine.

Finally the addition of the subject inventive control system to an existing single zone HVAC system will provide for the automatic provision of dynamic system balance each day.

In the attainment of the foregoing objects the invention contemplates as falling with the purview of the claims a control system for an air delivery system which is normally a single zone HVAC unit. The air delivery system includes a single air supply duct through which conditioned air is delivered. The control system assumes that there is at least one independently controlled zone or room which receives air delivered through an air delivery register.

The control system includes two basic components one of which is a wireless air flow thermostat control that communicates with and controls an electrically powered and electrically self sufficient register flow control unit which controls the flow of conditioned air through the air delivery register.

A typical system involves a plurality of zones each zone having one or more air delivery registers, each of which is coupled to the single air supply duct noted earlier.

The wireless air flow control thermostat transmits a wireless air flow control signal which is characterized as a continuously transmitted wireless temperature control signal for as long as a desired setpoint temperature for an associated zone is either above or below an ambient temperature in the associated zone.

The electrically powered and electrically self-sufficient register flow control unit controls the flow of air through the register in response to receiving the wireless flow control signal. This just noted register flow control unit includes an electrical generator, a rotor of which is coupled for rotation with a rotary mounted turbine positioned upstream within a register supply duct associated with an air delivery register. The passage of air flow against blades of the turbine causes the generator rotor to turn and the generator to provide electrical power to the electrically powered register flow control unit to thereby maintain the register flow control unit electrically self-sufficient. The register control unit also includes a re chargeable battery or other electrical storage device electrically coupled to a power supervisor and battery charging circuit that in turn receives electric power from the generator.

In systems where both heating and cooling unit are provided the register flow control unit also includes an HVAC temperature detector to determine when the HVAC unit is delivering heated or cooled air. The HVAC temperature detector has an output signal to a logic circuit representative of either heating or cooling by the HVAC.

In a preferred embodiment of the invention the register flow control unit includes a wireless airflow control signal detection circuit electrically coupled to a decoding circuit to provide an output signal from the decoding circuit to the logic circuit representative of whether an ambient temperature in a zone associated with the register flow control unit is greater than a desired setpoint temperature of the zone or whether the decoding circuit output is representative of the fact that the ambient temperature in the zone is less than or equal to the desired setpoint temperature in the zone.

The power supervisor and recharge circuit is electrically coupled across the generator and rechargeable battery. The power supervisor and recharging circuit provide an output signal to the logic circuit whenever the rechargeable battery is fully charged.

Finally the logic circuit provides the output signal which controls the loading of the generator whenever a preselected combination of output signals from the HVAC temperature detection circuit; the decoding circuit, and the power supervisor and recharging means call for decrease air flow through the air delivery register.

In addition to the foregoing attributes of the invention it is contemplated that the invention embraces a method of controlling air flow in an air circulation system. The method includes the steps of placing an air driven turbine coupled to drive a generator in an air flow path in the air circulating system and then loading the generator to cause the air driven turbine to reduce its rotary speed thereby obstructing air flow in the system and controlling air flow.

The enhancement to the invention involving air turbine blade pitch control noted hereinbefore embraces the idea that a register flow control unit includes art air driven turbine positioned in the register and a blade pitch controlled air turbine rotary which would be responsive to air flow through the register.

The air driven turbine has radially disposed blades coupled to a turbine hub mounted for rotation about an axis parallel to air flow through the register. The radially disposed blades are each rotatably mounted about an axis that intersects the turbine hub axis.

A blade pitch control arrangement is coupled to the blades and is responsive to the air turbine rotary speed to cause the blades to rotate into an air flow restricting position when the air circulating system is at start-up with system air flow rates at a minimum and into a reduced air flow restriction position allowing higher air flow rates when the rotary turbine speed has increased.

A braking mechanism is coupled to the turbine blade hub and is responsive to an external control signal to brake the hub upon command of the control signal. The braking of the turbine hub causes the blade pitch control mechanism to rotate the blades into a flow restricting position which produces a lower air flow rate from the register.

In a highly preferred embodiment of the invention the braking mechanism includes a generator coupled to the turbine hub to be driven thereby. The external control signal causes a loading of the generator so that the turbine hub is braked thereby reducing rotary turbine speed and causing the blade pitch control arrangement to rotate the blades into an air flow restricting position which produces a lower air flow rate from the register.

In less technical terms and by way of summary, assume that it is summer, during the cooling season and the air conditioning unit has just crone on in an office building. In the cooling operation, cooled air flows down the air supply duct through the register flow control unit and out an air delivery register. As the cool air flows down the air supply duct through the register flow control unit the flow of air turns a turbine that is drivingly attached to a rotor of a electrical generator that creates an electrical current that flows to a battery recharging circuit and reenergizes a battery as needed. This operation will continue until the wireless flow control thermostat has determined that the desired temperature level has been reached. Now that the room or zone is cool enough and further amounts of air are not only unnecessary, but waste costly energy, the system responds by having the wireless control thermostat signal electronic controls in the register flow control unit to restrict further air flow by retarding the rotation of the turbine. A turbine turning more slowly than the surrounding air will measurably affect a pressure change across the turbine to thereby reduce flow. The result is a significantly reduced air flow from the register flow control unit through the air delivery register.

The reduction in air flow from a single register in a multiple register system causes are increase in flow from other registers in the system. This accelerates the cooling in the other offices or zones. As each of them reaches a comfort set point selected by an office user, the register air flow control unit will reduce air flow to that office.

The result of restricting air flow to each office or room in this manner provides not only a substantial increase in comfort, but the achievement of comfort levels more quickly than the standard on/off method so that the air conditioning unit can be shut down sooner saving energy costs.

BRIEF DESCRIPTION OF THE DRAWINGS

The description setforth above, as well as other objects, features and advantages of the present invention, will be more fully appreciated by referring to the detailed description and the drawings that follow. The description is of the presently preferred but, nonetheless, illustrative embodiment in accordance with the present invention, when taken in conjunction with the accompanying drawing wherein;

FIG. 1 is a schematic layout of an office complex with a number of zones to be heated or cooled by employing the invention described herein;

FIG. 2 shows a portion of the air flow control system that embodies the invention;

FIG. 3 is a cross sectional showing of a register flow control unit that embodies the invention;

FIG. 4 is a side view of an air turbine shown in FIG. 3;

FIG. 5 is a top view taken along line 5—5 of the air turbine of FIG. 4;

FIG. 10 illustrates another embodiment of the invention.

DETAILED DESCRIPTIONS OF THE PREFERRED EMBODIMENTS

Figures 6, 9:
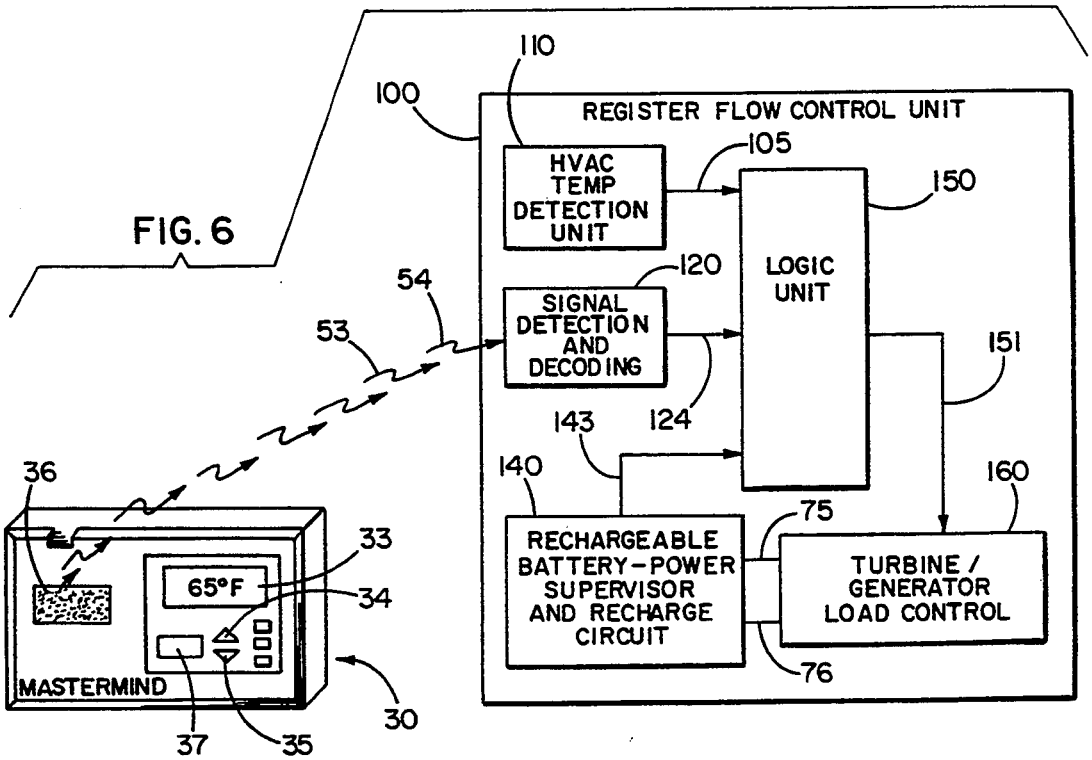
FIG. 6 is a block diagram illustration of air control system that embodies the invention.
FIG. 9 is a logic unit block diagram.

Reference is now made to FIG. 1 which illustrates schematically an office complex in a building not shown. The office complex includes three (3) zones to be provided with forced hot or cooled air from a HVAC (heating, ventilating, air conditioning) unit 15. Zone #1 is defined by a pair of side walls 19, 20, 21, a ceiling 22 and floor 23. A fourth side wall is present, but not shown. Accordingly zone #1 is a one of many office rooms in the office complex. Zones #2 and #3 are similar in overall configuration as zone #1. Each of the zones #1, #2 include wall mounted wireless air flow control thermostats (30, 31) to be described more fully hereinafter with respect to FIG. 7. Zone #3 is provided with a conventional ON/OFF thermostat 32 electrically coupled via an electrical line 16 to HVAC controller 17. Electrical power is provided to the wireless air flow control thermostats 30, 31 from an AC power supply 40 via electrical line 41, 41*a*. Line 41*a* leads to a wall outlet 42 which has schematically shown a zone manager power supply 43 to provide electrical power via line 44 to wireless air flow control thermostat 30. The wireless air flow control thermostat 31 of zone #2 is connected as shown to the AC power supply 40 in a similar manner as that shown and just described. Wireless airflow control signals 53, 54 depicted as jagged separated lines are shown directed toward an air diffuser portion 61 of air delivery register 60. The HVAC 15 delivers conditioned air to zones #1 and #2 via a single air supply duct 18 and branch air supply ducts 18*a*, 18*b*. Positioned in branch air supply ducts 18*a*, 18*b* as shown in FIG. 2 and FIG. 3 are the electrically powered and electrically selfsufficient register flow control units 70, 71 of the instant invention.

In order to appreciate how the register flow control units 70, 71 operate, one of the units 70 is shown in FIG. 2 and in partial section in FIG. 3 in order to reveal the relationship of the various component parts of the register flow control unit.

Turning now to FIG. 2 there is shown an end portion of the single air supply duct 18 with a branch air supply duct 18*a* secured thereto by means not shown. An air diffuser portion 61 which forms a major part of the air diffuser register 60 is secured to the branch air supply duct 18*a* by conventional means not shown. An electrically powered and electrically self-sufficient register flow control unit 70 is shown in position to demonstrate the manner in which air flow, indicated air flow arrows 72 and 73 pass by the register flow control unit when a turbine 80 is in a freewheeling mode.

In FIG. 2 an arrow 70 points toward the electrically powered and electrically self-sufficient register flow control unit 70. The register flow control unit is made up of two major elements, the first of which is an electronic control box 75, as indicated in FIG. 3, that is electrically coupled via leads 75, 76 to an output from a DC generator not shown but mounted within a rotatable supported air turbine hub 82. The hub 82 also forms the rotor of the DC generator. The generator could also be an AC generator with an alternating current output that could be rectified to provide DC power.

Figure 8:
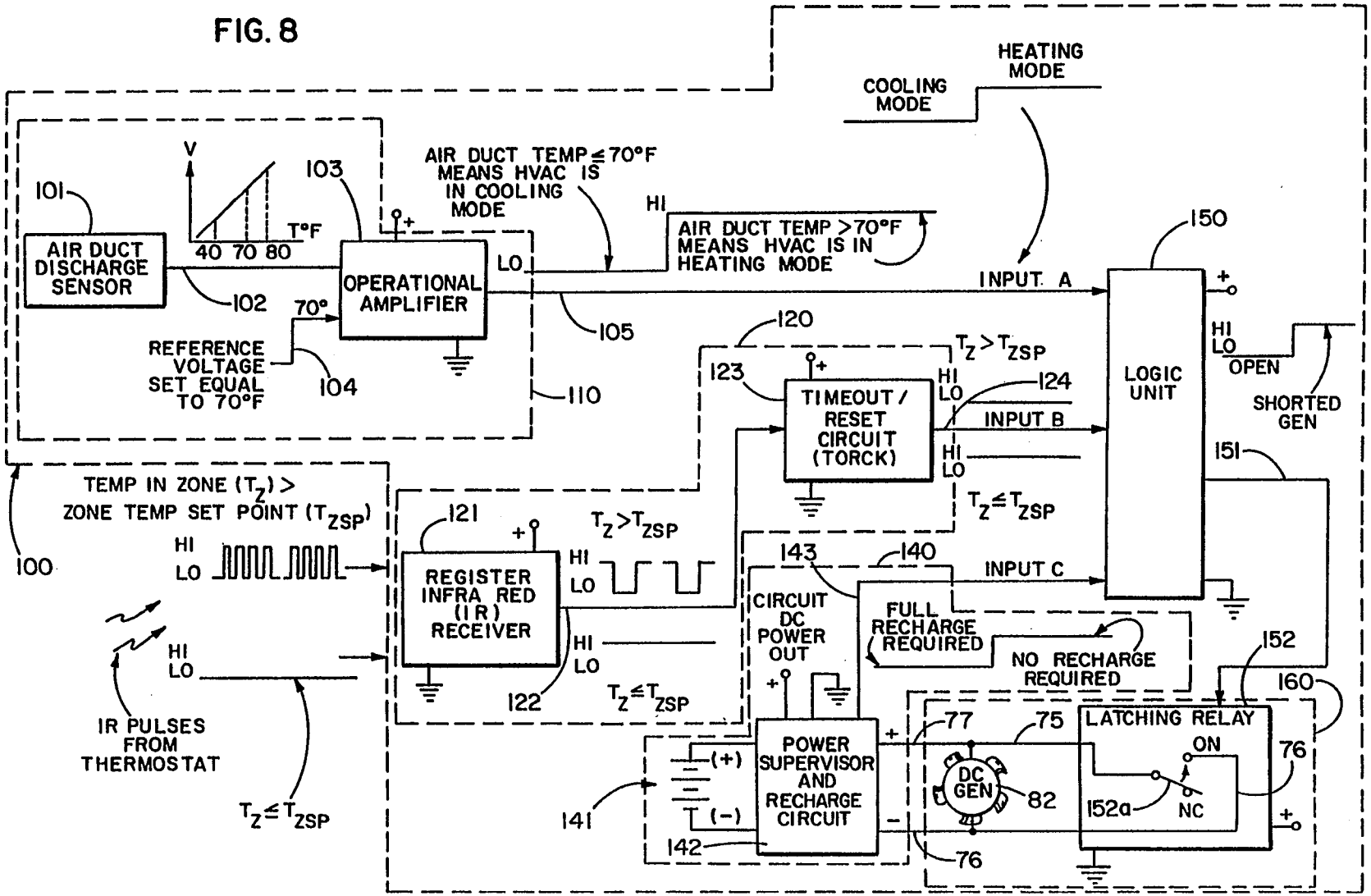
FIG. 8 is a schematic showing of the relationship of the components present in a register flow control unit embodying the invention.

The operation of the electronic circuitry in the electronic control box 75 which is secured to a structural member 78 by means not shown of the air delivery register 60 will be described in full when the operation of FIG. 8 is reviewed.

When FIGS. 3, 4 and 5 are studied together the operation and air passage reduction function of the turbine 80 and generator contained in air turbine hub 82 will become apparent. In FIG. 3 there is shown fitted in branch air supply duct 18*a* the turbine 80 and its hub 82 which contains a generator and which may be secured to the duct 18*a* by conventional means not shown. Secured to the turbine hub 82 are turbine impeller blades. Six blades of the turbine impeller have been identified with reference numerals in FIG. 4, namely turbine impeller blades 85, 86, 87 and 87, 88, 89. The arrangement of the turbine impeller blades is highly significant to the effective blockage of air flow past the turbine when the turbine blades and hub 82 are braked to reduce air flow through the air delivery register 60. The braking function of the turbine/generator rotor 82 will be explained more fully hereinafter.

Turning now to FIGS. 4 and 5, it will observed that turbine hub 82 has disposed around it circumference two rows of off-set turbine impeller blades 83, 84 as indicated in FIG. 4 shown. Turbine impeller blades 85, 86, 87 are in an upper circumferential row 83, whereas turbine impeller blades 88, 89, 90 are in a lower circumferential 84 row. The significance of this arrangement will be appreciated when FIG. 5 is viewed. FIG. 5 is a top down view of FIG. 4 and clearly shows how the downward flow of air as indicated by air flow arrows 91, 92, 93 is obstructed by for example by the combination of the off-set turbine impeller blades 85, 88, 86. Returning to FIG. 4 and a study of the air flow arrows 91, 92, 93, it has been discovered that when the turbine impeller blades of this just described configuration are employed and the turbine/generator rotor 82 is in a free wheeling mode the turbine 80 offers little resistance to the passage of air past the air turbine 80.

Reference is now made to FIG. 6 which depicts in schematic form the basic components of the control system for an air delivery system embodying the invention. On the left, as FIG. 6 is viewed, is wireless air flow control thermostat 30, which includes conventional set temperature readout 33; manually operable temperature increase and decrease select buttons 34, 35; heating or cooling select button 36, and infra red (IR) transmitter 37. The register flow control unit 100 which is electrically powered and is electrically self-sufficient is shown schematically in FIG. 6 on the right side of the drawing. A detailed layout of the register flow control unit 100 is shown in FIG. 8 and will be described in detail hereinafter. It is sufficient to note at this point that the register flow control unit 100 includes, interconnected as shown, five basic functional components, namely, an HVAC temperature detection circuit or unit 110; a wireless air flow control signal detection and decoding unit or circuit 120; a rechargeable battery/power supervisor and recharge unit 140; a logic unit 150, and a turbine/generator load control 160.

Figure 7:
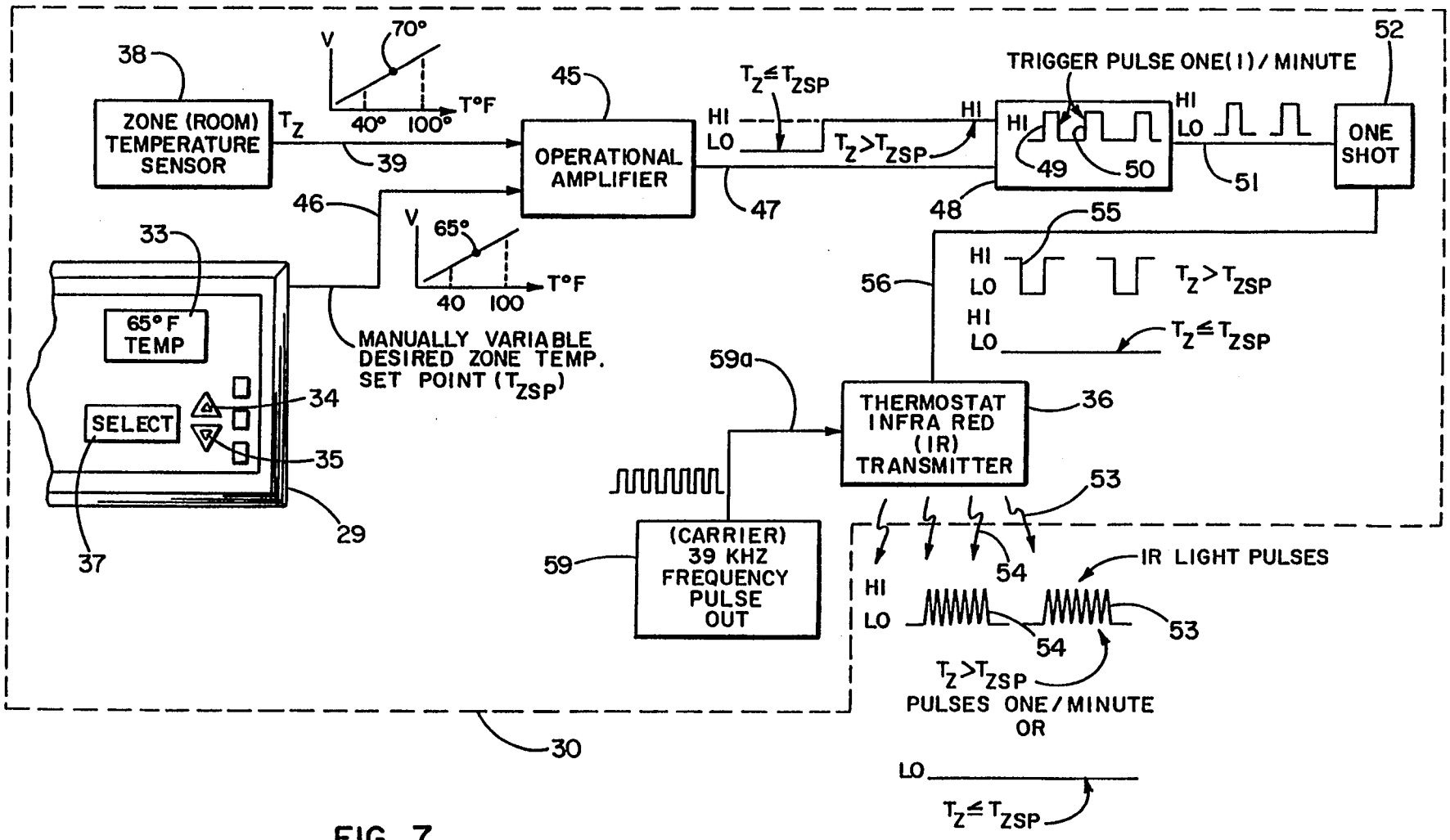
FIG. 7 is a schematic showing of the relationship of the components present in a wireless flow control thermostat employed in the invention.

Attention is now directed to FIG. 7 which illustrates in block diagram layout the details of the wireless air flow control thermostat 30 employed in zone #1 of FIG. 1. The wireless control thermostat 31 in zone #2 is of the same configuration and operates in a similar fashion.

In the left had portion of the drawing of FIG. 7 there is shown in broken away fashion an external portion 29 of the wireless air flow control thermostat 30 described with respect to FIG. 6. Shown in broken line 29 surrounding the block diagram are the essential component parts of the wireless air flow control thermostat 30 which will now be described. The wireless thermostat 30 includes in a conventional manner a zone or room temperature sensor 38 which provides on an output lead 39 a signal representative of the rooms ambient temperature, Tz, at any given moment. The ambient temperature signal on lead 39 is delivered to an operational amplifier 45 which has as another input, lead 46 which provides a manually variable, desired zone temperature setpoint (Tzsp). In the situation being described the Tzsp has been selected by the zone #1 occupant at 65° F. The operational amplifier 45 functions in a conventional manner and provides on output lead 47 a low (Lo) output whenever the ambient zone temperature Tz is less than or equal to the zone temperature setpoint Tzsp, (Tz<Tzsp) here 65° F. and a Hi output whenever the ambient zone temperature Tz is greater than the zone temperature setpoint Tzsp (65° F.), namely Tz>Tzsp. The lead 47 is connected as shown to a trigger pulse circuit 48 which responds to produce trigger pulses 49, 50 at the rate of one per minute whenever the output signal on lead 47 from the operational amplifier 45 goes Hi. The trigger pulses 49, 50 appears on lead 51 where they are delivered to a one shot circuit 52 that produces the wave form output 55 on lead 56 whenever and for as long as Tz>Tzsp. The wave form output 55 appears on lead 56 where it triggers the thermostat infrared (IR) transmitter 36 to provide the wireless IR signals 53, 54 to the register flow control unit 100 not shown in this figure. A carrier frequency source 59 of 39 KHZ modulates the IR signal output over lead 59*a* to provide the wave forms 53, 54 shown below as jagged line IR signals 53, 54. It should be apparent that when the temperature in the zone Tz is less than or equal to the zone temperature setpoint Tzsp i.e. 65° F. there will be no IR transmitter 36 output.

Attention is now directed to FIG. 8 which illustrates in a schematic block diagram form the internal workings of the register flow control unit 100 shown in broken line. At the left hand side of the drawings of FIG. 8 there is shown in broken line an HVAC temperature detection unit or circuit 110. This HVAC temperature detection circuit 110 includes two major components, namely, an air duct discharge sensor 101, interconnected via a lead 102 to an operational amplifier 103. The sensor 101 and operational amplifier 103 are conventional in nature. The air duct discharge sensor 101 is positioned in the system so that conditioned discharge air flowing from the main supply duct 18 via duct branch 18(*a*) (FIG. 1) engages the sensor 101 prior to entering a region near the air turbine 80. For purposes of illustration only such air discharge sensor 101 is shown in FIG. 1 as a small box in dotted outline just above the register flow control unit 70. The air duct discharge sensor is designed to provide a linear output over a range of temperatures that may be present in the main and branch supply ducts 18, 18*a*. A reference voltage representative of preselected temperature eg 70° F. is provided via lead 104. The basic function of the HVAC temperature detection circuit 110 is to provide on operational amplifier output lead 105 a signal indicative of whether the air flow control system is operating in the heating or air cooling mode. The temperature of 70° F. has been selected as a reference point. Whenever the air coining from HVAC unit 15 through ducts 18, 18*a* is above 70° F., this condition will be considered to be a heating mode, whereas if the temperature of the air from the HVAC is below 70° F. the system will be considered to be its cooling mode. Accordingly, the operational amplifier 103 is designed to provide a Lo output on lead 105 indicating the HVAC is in a cooling mode, whereas a Hi signal on lead 105 is indicative of the HVAC as operating in a heating mode. The Hi or Lo outputs on lead 105 are delivered to logic unit 150, the function of which will be described hereafter.

Just beneath the HVAC temperature detection unit 110, also shown setout in broken line is the wireless air flow control signal detection and decoding unit or circuit 120. The basic function of this just noted unit 120 is to receive i.e. detect the wireless IR signals 53, 54 frown the wireless air flow control thermostat 30 and decode the transmitted information from the wireless air flow control thermostat transmitter 36.

The wireless IR signals 53, 54 are received by infrared (IR) receiver 121 which in turn provides a signal out on lead 122 representative of an envelope 123 of the signals 53, 54. The possible output signals on lead 122 are shown for the conditions Tz>Tzsp which represents zone ambient temperature greater than zone temperature setpoint which had been arbitrarily set at 65° F. for purposes of explaining the air flow control system operation.

The just described output on lead 122 is delivered to timeout/reset circuit (TORCKT) 123 which provides an output on lead 124 to the logic unit 150. The TORCKT 123 is designed to provide a low (Lo) output on lead 124 when the IR pulses are representative of the condition Tz<Tzsp and a Hi output on lead 124 when the IR pulses are not present on the lead 122 to the TORCKT 123 for 5 minutes. When this state is present the output on lead 124 goes Hi indicating that Tz<Tzsp.

Located in the lower right hand corner of the drawing of FIG. 8 are a rechargeable battery/power supervisor and recharge unit 140 and a turbine/generator load control unit 160. The rechargeable battery/power supervisor and recharge unit 140 includes a rechargeable battery 141 and a power supervisor and recharge circuit 142 electrically connected as shown. Direct current power is provided by leads 76, 77 which are connected across the stator windenings (not shown) contained within of the air turbine hub 82. It will be recalled that when air is flowing through the system, the flow of air will cause the air turbine 80 to turn thereby driving a DC generator within hub 82 and provide electrical power to recharge and maintain charged the rechargeable battery 141 via the power supervisor and recharge circuit 142. The power supervisor and recharge circuit 142 are of conventional design and provide an output signal on lead 143 to the logic unit 150 whenever the rechargeable battery 141 is fully charged.

The logic unit 150 has a single output on lead 151 which is electrically connected to a latching relay 152 which when energized goes from a normally closed (NC) electrical contact position to a normally open (NO) electrical contact position. When the latching relay 152 is activated. The electrical leads 76 and 77 are shorted by movement of relay contact 152*a* from its NC position to its NO position. This shorting places a shorting load across the stator windings of the generator with turbine hub 82 which results in the air turbine 80 slowing its rotational movement until it has come to a stopped or nearly stopped condition which will provide a maximum reduction in air speed past the turbine 80. This results in significantly reduced air flow through the register air flow control unit 100 and an delivery register 60 in particular. It should be understood that the invention contemplates as included with in the language of the claims solid state electronic devices in place of for example, the latching relay 152.

An understanding of the full operation of air control system is readily discernible when the "Logic Unit" of FIG. 9 is studied in conjunction with the earlier described units and circuits.

Another embodiment of the invention maybe seen in FIG. 10 where an air turbine and a generator 130 of the type shown in FIG. 4 are positioned in a duct 180 through which a fluid medium, such as air, is passing. The air turbine/generator 130 provides electrical power on leads 181, 182 to a load 183 to powered by the electricity generated by the generator of air turbine/generator 130. The load 183 may be a motor or any other electrically powered device.

Figure 11:
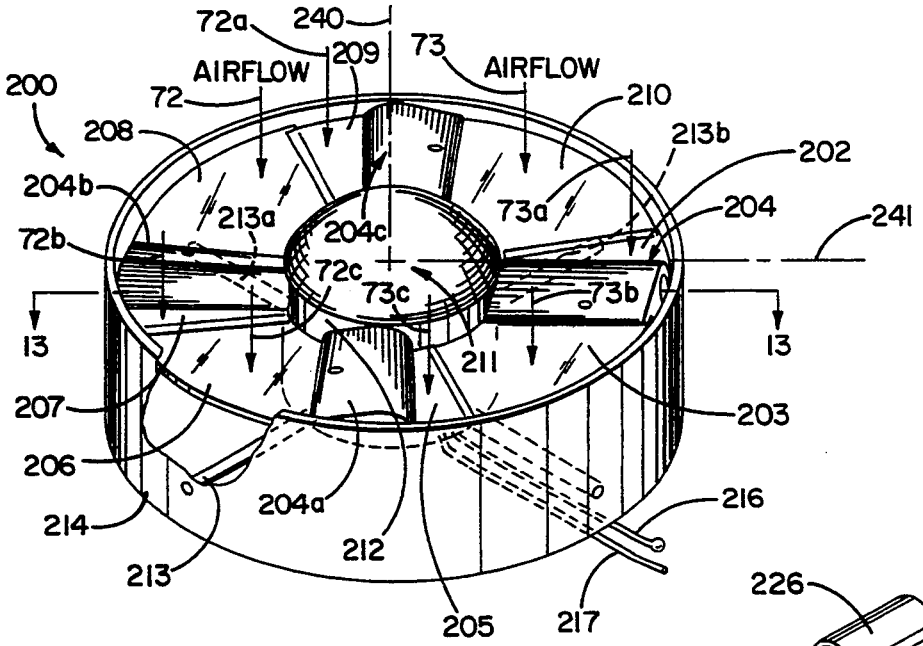
FIG. 11 is a three dimensional view of yet another embodiment of the invention.

Reference is now made to FIG. 11 which illustrates in a three dimensional form an enhancement to the invention which involves an air turbine blade pitch control and generator unit 200. The air turbine blade pitch control and generator unit 200 would take the place of turbine/generator 80/81 shown is FIG. 2 and 3. In order to maintain a sense of descriptive continuity, air flow arrows 72, 73 shown in FIG. 2 and 3 will be employed in the description the blade pitch control and generator unit 200 as this unit and its various features and functions are explained in FIG. 11 thru 16.

Figure 12:
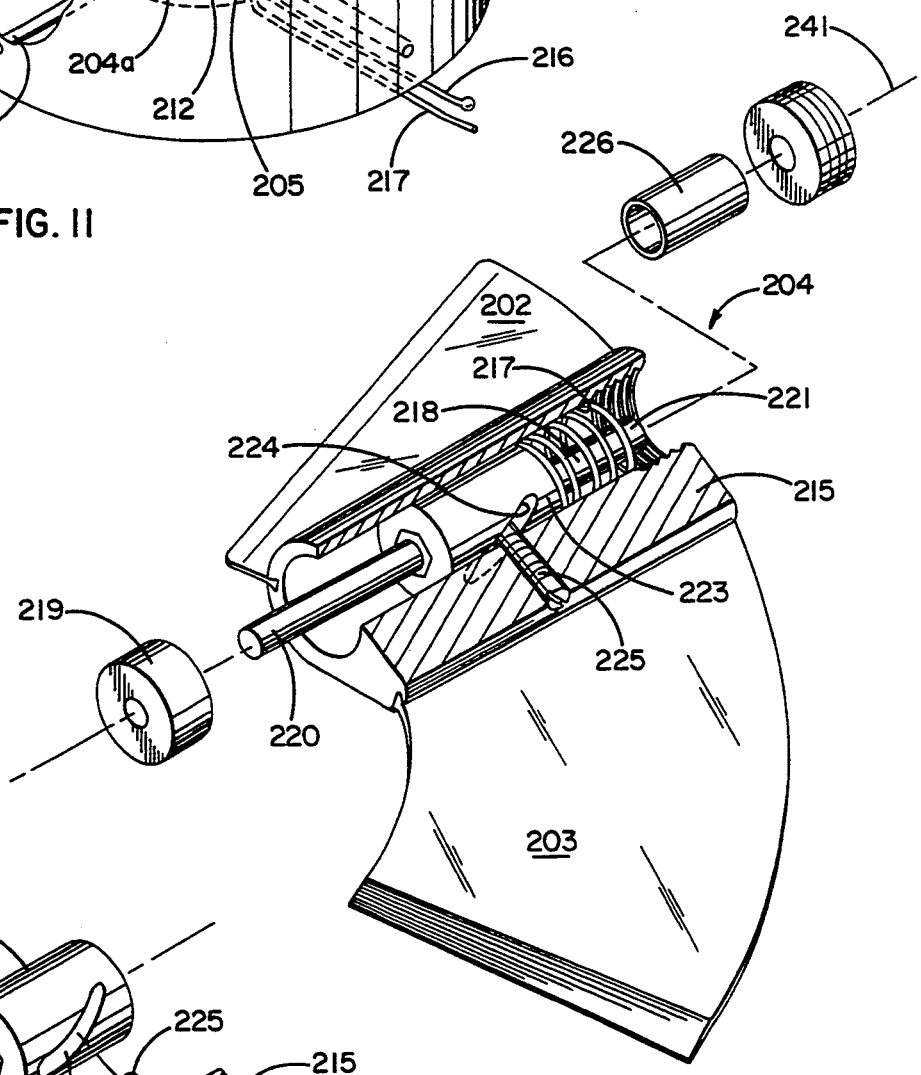
FIG. 12 is a three dimensional drawing of an air turbine blade with a portion sectioned and internal components of a blade pitch control unit employed in the practice of this embodiment of the invention shown in an exploded manner.
Figure 13:
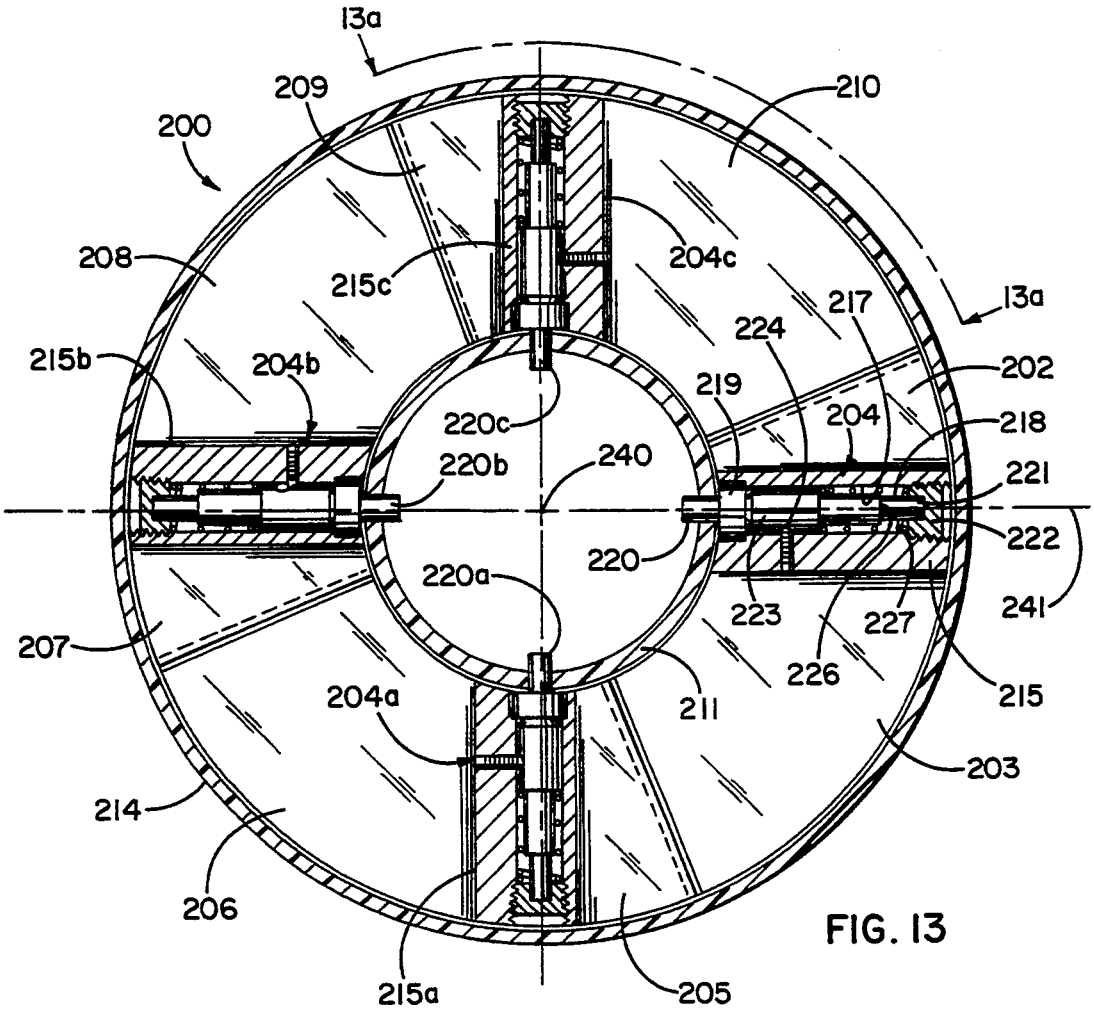
FIG. 13 is a front view section of the embodiment of the invention shown in FIG. 11.

In order to better appreciate the nature of the cooperation between the various components of FIG. 11, attention is directed to FIGS. 12 and 13 where a detailed three dimensional illustration of an air turbine blade 202, 203 and pitch control arrangement 204 is shown in FIG. 12, whereas in FIG. 13 a cross-sectional view is provided.

The air turbine blade pitch control and generator unit 200 is shown with four blade sets, namely 202/203; 205/206; 207/208; 209/210. It is to be understood that the invention may employ more or less than four blade sets without departing from the spirit of the invention.

Before a detailed explanation of the turbine blade pitch control arrangement 204 is undertaken further details of the unit 200 as shown in FIG. 11 will be provided.

Figure 13A:
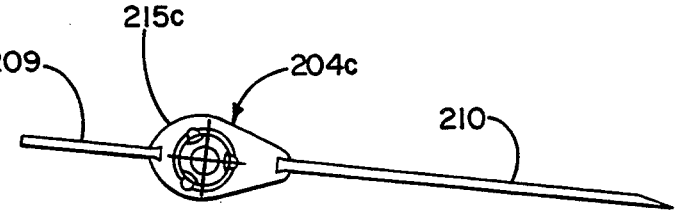
FIG. 13*a* is an end view of a single air turbine blade of FIG. 13 taken along line 13*a*–13*a* when the air turbine blades are in an increased air flow restricting position.

As is visually evident the unit 200 has the four blade sets noted above. Blade set 202, 203 has integrally interposed therebetween a blade pitch control arrangement 204. The blade set 202, 203 may be secured to the blade pitch control arrangement 204 by a mechanical arrangement as shown in FIG. 13*a* where blade set 209, 210 are shown integrally connected to blade pitch control arrangement 204*c*. It should be understood that the four blade sets may also be formed integrally with the blade pitch control arrangement outer housings 215, 251*a*, 215*b*, 215*c*.

Each of the blade sets and integral blade pitch control arrangements 204, 204*a*, 204*b*, 204*c* are mechanically coupled to a turbine blade hub 211 by means turbine blade support shafts 220, 220*a*, 220*b*, 220*c* as best identified in FIG. 13. The blade support shafts may be secured to the hub by any suitable means. In FIG. 13 a friction fit is depicted. For greater security a pin not shown may be passed through the shafts to prevent centrifugal forces from forcing the blade sets and related support shafts from moving radially outward. The turbine blade hub 211 is coupled by means not shown to a generator not shown but contained in generator support housing 212 (see FIG. 11). An external air turbine blade pitch control and generator unit external housing 214 supports via housing support rods 213, 213*a*, 213*b* the generator support housing 212 and turbine blade hub 211 with its associated blade sets previously described.

Generator electrical leads 216, 217 functionally correspond to leads 76, 77 of FIG. 3 and are connected to an electronic control box 75 not shown in FIG. 11 but described in detail earlier in the specification.

Figure 14:
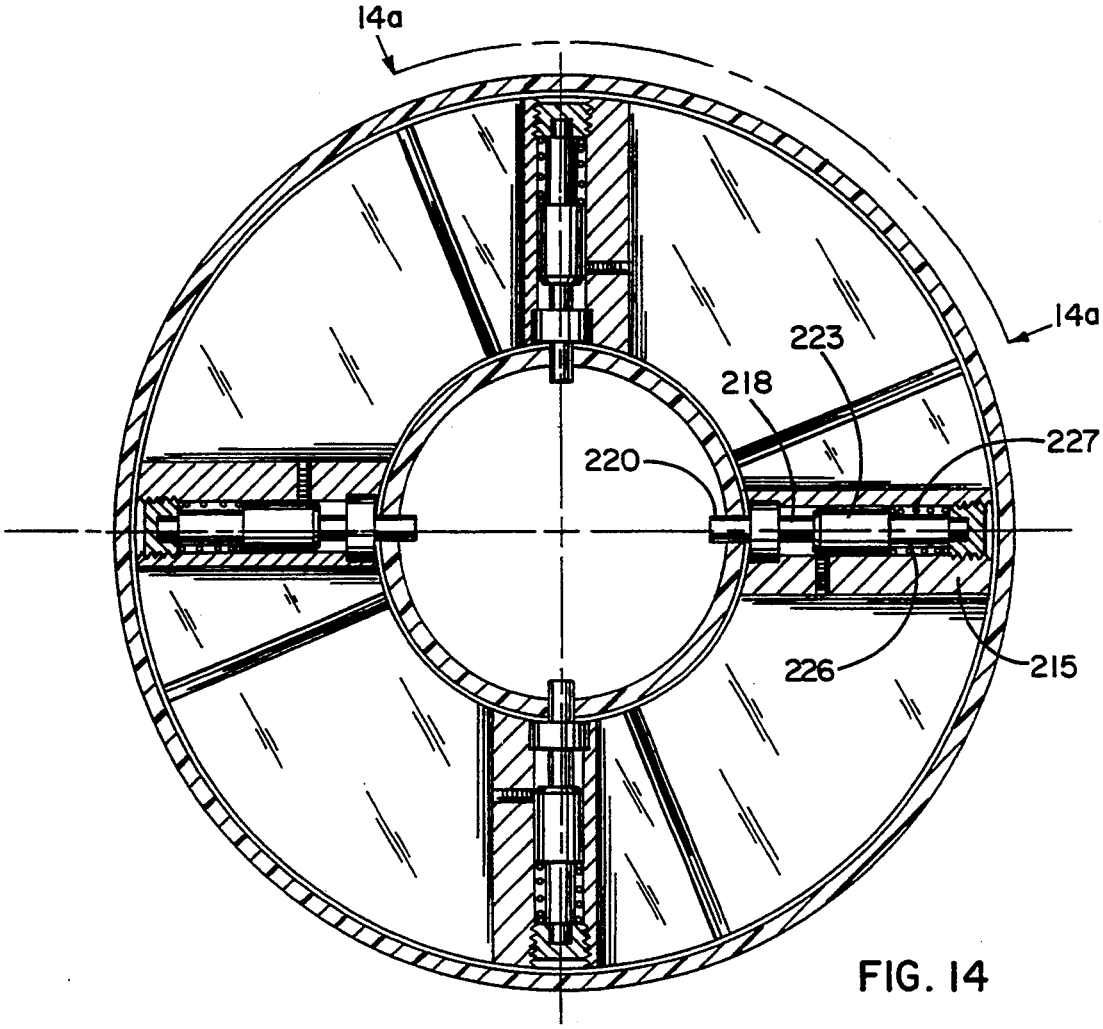
FIG. 14 is a front view section of the embodiment of the invention shown in FIG. 11 when air turbine blades are in a reduced air flow restriction position.
Figure 15:
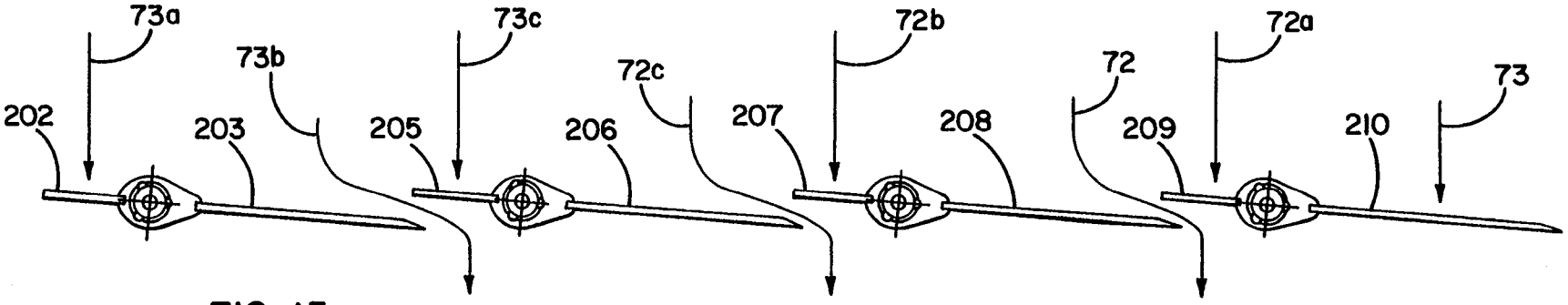
FIG. 15 is a roll-out view of the air turbine blades of FIG. 13 showing relative turbine blade position during increased air flow restriction.
Figure 16:
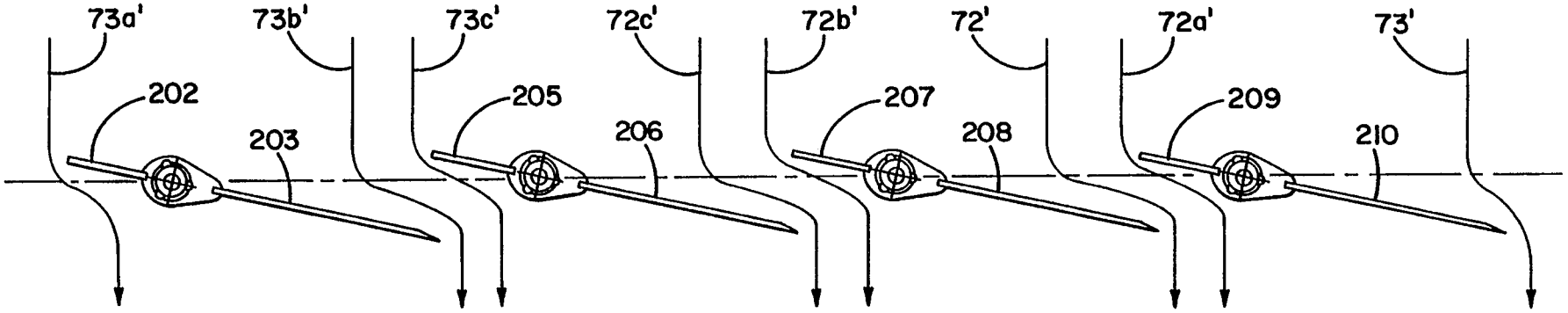
FIG. 16 is a roll-out view of the air turbine blades of FIG. 14 showing relative blade position during reduced air flow restriction.

A multitude of air flow arrows 72, 72*a*, 72*b*, 72*c*, 73, 73*a*, 73*b*, 73*c* are shown in FIG. 11 as well as FIGS. 15 and 16. The nature of the cooperation of the air flow arrows and air flow will be setforth specifically with respect to a description of FIGS. 13, 14 and 15, 16 to follow.

The air turbine blade pitch control and generator unit 200 is designed to control flow of air through a register 60, FIG. 3 from a register air flow supply duct 18, see FIGS. 1 and 2, in response to an externally provided control signal 53, 54, see FIG. 6, that commands a register flow control unit 100, FIG. 6 to provide differing air flow rates through the register 60. An air turbine blade pitch control and generator unit 200, FIGS. 11 thru 14, includes a rotary mounted air turbine i.e. Blade hub 211 and blade sets 202, 203; 205, 206; 207, 208; 209; 210 which are positioned within the air flow supply duct 18*a*, FIG. 2. The just noted air turbine is coupled a generator (not shown) located in generator support housing 212. The action of air flow (see air flow arrows 72, 72*a*, 72*b*, 72*c* and 73, 73*a*, 73*b*, 73*c*) against the blade sets of the turbine cause the air turbine to rotate and drive the generator.

Operational Overview

The air driven turbine initially restricts air flow, in a manner to be described, at the register at system start-up. The turbine blade hub 211 is mounted for rotation about an axis 240 (FIG. 11) which axis is parallel to air flow through the register. The turbine blade sets and associated pitch control arrangements are each rotatably mounted an axis eg. Axis 241 FIG. 11, 12. The axis 241 intersecting the turbine hub axis 240 as depicted in FIG. 11. Each of the blade pitch control arrangements 204, 204*a*, 204*b*, 204*c* are integrally connected respectively to blade sets 202, 203; 205, 206; 207, 208; 209, 210. The blade pitch control arrangements 204, 204*a*, 204*b*, 204*c* are responsive to the air turbine rotary speed to cause the blade sets to rotate into an air flow restricting position FIGS. 13*a* and 15 when the air circulating system is at start-up with system air flow rates at a minimum and into a reduced air flow restriction position, FIG. 14*a* and FIG. 16 allowing higher air flow rates when the rotary turbine speed has increased. The register flow control unit 100 is responsive to the externally provided control signal to provide a loading to the generator so that the air turbine hub is braked to thereby reduce rotary turbine speed and cause the blade pitch control arrangements 204, 204*a*, 204*b*, 204*c* to rotate the associated blade sets 202, 203; 205, 206; 207, 208; 209, 210 into an air flow restricting position FIG. 13, FIG. 15 which produces a lower air flow rate from the register.

Attention will now be directed to an explanation of the operation of the blade pitch control arrangements 204, 204*a*, 204*b*, 204*c*. More specifically the blade pitch control arrangement 204 as best seen in FIGS. 12 and 13 will be discussed. No claim of novelty is made for the blade pitch control arrangement now to be described.

Figure 11A:
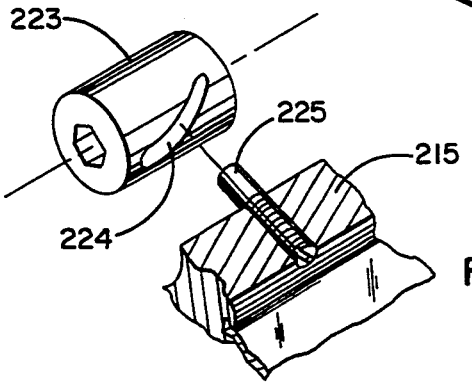
FIG. 11*a* is a detailed three dimensional illustration of an air turbine blade and pitch control arrangement features as shown in FIG. 11.

The various elements of the blade pitch control arrangement will be described and then their overall functional cooperation will be set forth. Accordingly, in FIGS. 12 and 13 the blade pitch control arrangement 204 is comprised of and outer housing 215 which includes a circular in cross-section passage 217 concentric with axis 241. Located with the bore of the passage 217 is a centrally disposed centrifugal weight support rod 218 having a multi-sided configuration. At the left hand end of the support rod 218 the rod has been formed into a turbine blade support shaft 220 described earlier. The turbine blade support shaft 220 is supported in place by a sleeve bearing 219 positioned as shown in FIG. 13. The opposite end 221 of the centrifugal weight support rod 218 is formed to cooperate with a threaded plug 222. A centrifugal weight 223 is provided with a centrally disposed opening that has a mating relationship with the support rod 218 multi-sided configuration. The weight is mounted on the support rod for sliding movement, but can not rotate because of mating relationship just noted and the fact the support rod 218 is secured against rotation. The weight 223 is provided with a cam slot 224. A cam slot pin 225 best seen in FIG. 11*a* and FIG. 12 engages the cam slot 224 of the weight 223. A travel limit stop spacer 226 having a circular internal cross-section surrounds the support rod 218 for sliding movement thereon. A spring 227 cooperates at one end with threaded plug 222 and at its other end with centrifugal weight 223.

The operation of the blade pitch control arrangement 204 is straight forward. In FIG. 13 the air turbine and the blade pitch control arrangement 204 is shown as it would be at system start-up, meaning that the air turbine with its associated blade sets would be as shown in the air turbine roll-out view of FIG. 15. In FIG. 15 it will be observed that the over lapping nature of the blades e.g. 203/205 block air flow as indicated by air flow arrows 73*b*, 73*c*. After system start-up the air flow rate increases and begins to place a torque on the blade sets due to the difference in area of the blades. As the blades begin to separate i.e. open the air turbine increases its rotational speed opening further, until the turbine blade sets take on the position shown in FIG. 16. The movement of the blade sets from that shown in FIG. 15 to that shown in FIG. 15 is brought about by the blade pitch control arrangement 204, 204*a*, 204*b*, 204*c*.

Attention is now directed to FIG. 14 which shows the affect on blade set pitch brought about by increasing the rotary speed of the air turbine. Increased rotary speed causes the centrifugal weighs e.g. 223 to move radially outward causing cam slot pin 225 to interact with cam slot 224 which results in the rotation of the other housing 215 of the blade pitch control apparatus 204 to rotate along with the associate blade set.

Figure 14A:
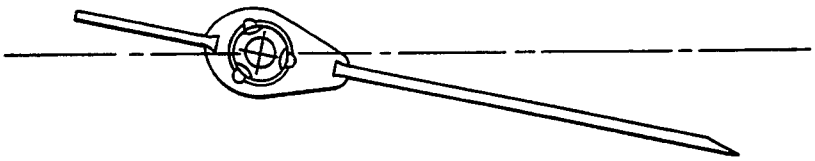
FIG. 14*a* is an end view of a single air turbine blade of FIG. 14 taken along line 14*a*–14*a*.

FIGS. 14*a* and FIG. 16 illustrate the turbine blade position which provides a reduced air flow restriction. It should be readily appreciated that the sizing of the spring 227 and travel limit stop spacer 226 control the degree to which the rate at which the blade pitch changes as well as the maximum blade pitch change.

It will be recalled that when an external control signal is delivered to the register flow control unit causing a load to be placed across the generator, the generator coupled to the turbine hub 211 causes the hub to be braked which reduces its rotational speed. A judicious selection of the spring constant for the spring 227 will allow for a relatively rapid transition from the turbine being in a free wheeling reduced flow restriction mode to an air flow restricting position which will produce a lower air flow rate from the register.

Though the invention has been described with respect to a pair of specific preferred embodiments thereof, many variations and modifications will immediately become apparent to those skilled in the art. It is therefore the intention that the appended claims be interpreted as broadly as possible in view of the prior art to include all such variations and modifications.

What I claim is new:

1. A method of controlling air flow in an air circulating system, comprising the steps of:

(a) initially restricting air flow in a portion of said system at system startup by means of an air driven blade pitch controlled turbine positioned in said air flow of said air circulating system, (b) reducing said air flow restriction caused by said air driven blade pitch controlled turbine in said air flow in response to an increase in rotary speed of said air turbine induced by passage of air flow through said air flow turbine after initial staff-up, and (c) braking said air driven turbine to reduce rotary speed and return to a condition of initial air flow restriction in said portion of the system as that of system at start-up.

2. The method of claim 1 wherein said air driven turbine has radially disposed blades coupled to a turbine hub mounted for rotation about an axis parallel the air flow in said portion of said system.

3. The method of claim 2 wherein said radially disposed blades are each rotatably mounted about an axis that intersects said turbine hub axis.

4. The method of claim 3 wherein a blade pitch control means is coupled to said blades and is responsive to the air turbine rotary speed to cause said blades to rotate into an air flow restricting position when said air circulating system is at start-up with air circulation at a minimum and into a reduced air flow restriction position when said rotary turbine speed has increased.

5. The method of claim 4 wherein a braking means is coupled to said turbine hub to brake said hub upon command to thereby reduce said rotary turbine speed and cause said blade pitch control means to rotate said blades into said air flow restricting position.

6. The method of claim 5 wherein said turbine hub is coupled to a generator to be driven thereby and the braking of said air driven turbine is accomplished by the step of loading said generator.

7. A method of controlling air flow in an air circulating system, comprising the steps of:

(a) initially restricting air flow in a portion of said system at system start-up by means of an air driven turbine coupled to drive a generator positioned in said air flow of said air circulating system, (b) reducing said air flow restriction caused by said air driven turbine/generator in said air flow in response to an increase in rotary speed of said air turbine, induced by passage of air flow by said air flow turbine after initial system start-up, and (c) loading said generator to cause the air driven turbine to reduce rotary speed and return to the initial air flow restriction of that at system start-up thereby controlling air flow in said portion of said system.

8. The method of claim 7 wherein said air driven turbine has radially disposed blades coupled to a turbine hub mounted for rotation about and axis parallel to the air flow in said portion of said system.

9. The method of claim 8 wherein said radially disposed blades are each rotatably mounted about an axis that intersects said turbine hub axis.

10. The method of claim 9 wherein a blade pitch control means is coupled to said blades and is responsive to air turbine rotary speed to cause said blades to rotate into an air flow restricting position when said air circulating system is at start-up with air circulation at a minimum and into a reduced air flow restriction position when said rotary turbine speed has increased, said loading of said generator and decrease in air turbine rotary speed causing said pitch control means to rotate said blades into said air flow restricting position.

11. An air flow controllable register unit for controlling flow of air through the register from an air circulating system having a register air flow supply duct, said controlled flow in response to an externally provided control signal that commands said register air glow control unit to provide differing air flow rates through said register, said air flow controllable register comprising:

a register flow control means having an air driven turbine positioned in said register, said turbine responsive to air flow through said register, said air driven turbine initially restricting air flow at said register at system start-up.

said air driven turbine having radially disposed blades coupled to a turbine hub mounted for rotation about an axis, said radially disposed blades are each rotatably mounted about an axis that intersects said turbine hub axis, a blade pitch control means coupled to said blades and responsive to the air turbine rotary speed to cause said blades to rotate into said air flow restricting position when said air circulation system is at start-up with system air flow rates at a minimum and into a reduced air flow restriction position allowing higher air flow rates when said rotary turbine speed has increased, a braking means coupled to said turbine blade hub and responsive to said external control signal to brake said hub upon command of said control signal to thereby reduce said rotary turbine speed and cause said blade pitch control means to rotate said blades into said air flow restricting position which produces a lower air flow rate from the register.

12. An air flow controllable register unit for controlling flow of air through the register from an air circulating system having a register air flow supply duct, said controlled flow in response to an externally provided control signal that commands said register air flow control unit to provide differing air flow rates through said register, said air flow controllable register comprising:

a register flow control means having an electric power generating means that includes a rotary mounted air turbine positioned within said register air flow supply duct, said air turbine is coupled to a generator to drive the same upon air flow against blades of said turbine, said air driven turbine initially restricting air flow at said register at system start-up, said air driven turbine having radially disposed blades coupled to a turbine hub mounted for rotation about an axis, said radially disposed blades are each rotatably mounted about an axis that intersects said turbine hub axis, a blade pitch control means coupled to said blades and responsive to the air turbine rotary speed to cause said blades to rotate into said air flow restricting position when said air circulating system is at start-up with system air flow rates at a minimum and into a reduced air flow restriction position allowing higher air flow rates when said rotary turbine speed has increased, said register flow control means responsive to said externally provided control signal to provide a loading of said generating means so that said air turbine hub is braked to thereby reduce said rotary turbine speed and cause said blade pitch control means to rotate said blades into said air flow restricting position which produces a lower air flow rate from the register.

* * * * *